US005740785A

United States Patent [19]

Dickey et al.

[11] Patent Number: 5,740,785

[45] Date of Patent: Apr. 21, 1998

[54] TWO WAY-HIGH PRESSURE LOOP, EXHAUST GAS RECIRCULATION VALVE

[75] Inventors: Daniel W. Dickey; Evan S Guy, both of Helotes, Tex.

[73] Assignee: Southwest Research Institute, San Antonio, Tex.

[21] Appl. No.: 871,204

[22] Filed: Jun. 9, 1997

[51] Int. Cl.[6] ..... F02M 25/07

[52] U.S. Cl. ..... 123/568; 123/570; 123/571; 60/605.2; 251/305

[58] Field of Search ..... 123/568, 569, 123/570, 571; 60/605.2; 251/129.11, 304, 305

[56] References Cited

U.S. PATENT DOCUMENTS

| | | | |
|---|---|---|---|
| 4,296,724 | 10/1981 | Iizuka et al. | 123/568 |
| 5,440,880 | 8/1995 | Ceynow et al. | 60/605.2 |
| 5,520,161 | 5/1996 | Klopp | 123/569 |
| 5,531,205 | 7/1996 | Cook et al. | 123/569 |
| 5,669,365 | 9/1997 | Gartner et al. | 123/570 |

*Primary Examiner*—Willis R. Wolfe
*Attorney, Agent, or Firm*—Jenkens & Gilchrist, P.C.

[57] ABSTRACT

A single exhaust gas recirculation valve selectively provides flow distribution of exhaust gas from an engine manifold to a turbocharger or exhaust gas recirculation system, and simultaneously provides back pressure for driving the recirculated exhaust gas to the intake manifold of the engine when the valve is positioned to recirculate all or part of the exhaust gas. A "wing-type" throttle blade is rotatably positioned within the valve and is selectively positionable between a first blocking position at which the exhaust gas recirculation port is blocked, and a second position at which the flow of exhaust gas to the turbine section of a turbocharger is blocked, as well as intermediate positions between the two blocked positions. The bearings supporting a shaft, to which the throttle blade is attached, are water cooled, as well as a mounting flange and shell surrounding an electric stepper motor coupled to the shaft. The present invention solves the problem of providing a compact EGR flow and back pressure valve in close proximity to the hot environment surrounding the exhaust manifold of an engine and a turbocharger.

11 Claims, 4 Drawing Sheets

TWO WAY-HIGH PRESSURE LOOP, EXHAUST GAS RECIRCULATION VALVE

BACKGROUND OF THE INVENTION

1. Technical Field

This invention relates generally to an exhaust gas recirculation valve, and more particularly to an exhaust gas recirculation valve for use in a turbocharged engine.

2. History of Related Art

Exhaust gas recirculation (EGR) is a known method for reducing the formation of various oxides of nitrogen ($No_x$) in the exhaust gas of an internal combustion engine. In a turbocharged engine, exhaust gas recirculation can be implemented by two different methods; a low pressure EGR loop, or a high pressure EGR loop. In the low pressure EGR loop arrangement, exhaust gas is diverted from the low pressure region of exhaust stream after passing through the turbine section of a turbocharger, and is then introduced into the low pressure region of the intake air stream before the compressor section of the turbocharger. Generally, an EGR back pressure valve and an EGR shutoff valve are required to control the respective opening, closing, and modulation of the respective passageways, and thereby control EGR flow.

In a high pressure loop (HPL) configuration, high pressure exhaust gas is diverted from the exhaust stream before the turbine section of the turbocharger and introduced into the high pressure intake air stream downstream of the compressor section of the turbocharger. Exhaust gas to be recirculated typically flows from an exhaust manifold into a "Y" shaped diverter, then flows through an EGR cooler and an EGR shutoff valve, into the intake manifold. The function of the EGR shutoff valve is to quickly close the EGR valve during engine transients. Required EGR varies greatly over the speed and load operating regimes of the engine. Increasing pressure in the exhaust system provides increased EGR flow. Therefore, a back pressure valve, positioned between the "Y"-shaped diverter and the turbine section of the turbocharger, is required to throttle the exhaust flow to create back pressure sufficient to drive the recirculated exhaust gas to the intake manifold of the engine. The EGR shutoff valve is closed when the engine is operating in regimes where no EGR flow is required.

However, the "Y"-shaped diverter, positioned in HPL exhaust systems between the exhaust manifold and the turbine section of the turbocharger turbine inlet, greatly increases the volume of the exhaust system on the upstream side of the turbocharger. There are two elements of exhaust energy that drive the turbine section of the turbocharger. One element is thermal mass flow, and the other element is impulse energy attributable to exhaust gas velocity. The thermal mass flow powers the turbine by flowing high temperature, high pressure exhaust gas through the turbine at a velocity sufficient to obtain usable energy. The impulse energy effect makes up a significant portion of the energy that drives the turbine. By making the exhaust manifolds very compact and flow efficient, diesel engine manufacturers are able to retain the high velocity impulse of exhaust gas from the "blow-down" event of each cylinder to assist in driving the turbocharger turbine. Adding any significant volume to the very compact exhaust manifold negates the effect of the impulse energy and leaves only the thermal mass flow to drive the turbine. The net result of added volumetric space upstream of the turbocharger turbine is a significant reduction in boost pressure and a corresponding reduction in the air/fuel ratio that is detrimental to the reduction of exhaust emissions.

The present invention is directed to overcoming the problems set forth above. It is desirable to have a compact exhaust gas recirculation valve that is positionable in close proximity to the exhaust manifold and turbocharger inlet of an engine. It is also desirable to have such a valve that is modulatable to selectively recirculate a portion of the gas exhausted from the exhaust manifold, or selectively direct all or a portion of the exhaust gas to the turbine section of a turbocharger while simultaneously increasing EGR system back pressure to modulate the flow of recirculated gas to the engine intake manifold. It is also desirable to have a liquid-cooled EGR valve that is suitable for use in the harsh, high-temperature, particulate-laden environment of an exhaust system, and also capable of rapid and frequent oscillation of the valve to improve system response to changes in engine operating conditions.

SUMMARY OF THE INVENTION

In accordance with one aspect of the present invention, an exhaust gas recirculation valve is adapted for positioning between an exhaust manifold and a turbocharger of an internal combustion engine. The exhaust gas recirculation valve includes a housing having an exterior surface, an interior surface defining an internally disposed chamber, an inlet port extending between the interior surface and the interior chamber and adapted for fluid communication with the exhaust manifold of the engine. The housing also includes a first discharge port extending between the internal chamber and the exterior surface and adapted for fluid communication with a turbine inlet port of the turbocharger, and a second discharge port extending between the interior surface and the exterior surface of the housing and adapted for fluid communication with an intake port of the engine. The housing further includes a first bore extending between the internal chamber and the exterior surface of the housing that is concentrically formed about a longitudinal axis extending through the internal chamber, and a second bore, coaxially aligned with the first bore, that extends between the internal chamber of the housing and an opposed exterior surface of the housing. The exhaust gas recirculation valve embodying the present invention further includes a shaft rotatably mounted in the bore formed in the housing, and a throttle blade fixedly attached to the shaft. The throttle blade has a first portion that is shaped to block the first discharge port when the shaft is rotated to a first position, and a second portion spaced from the first portion that is shaped to block the second discharge port when the shaft is rotated to a second position. The exhaust gas recirculation valve further includes a means for rotating the shaft between the first and second positions and to selective intermediate positions between the first and second positions.

Other features of the exhaust gas recirculation valve embodying the present invention include plurality of passageways disposed in the housing, each of which extend from the exterior surface of the housing to a respective one of the bores formed in the housing. Each of the passageways are adapted for respective connection with either a source of coolant or a coolant drain, whereby a flow of liquid is respectively provided to the first and second bores through said passageways connected with said source of coolant and discharged through said passageways connected with the coolant drain.

Other aspects of the exhaust gas recirculation valve embodying the present invention include the first and second coaxially aligned bores in the housing, each having a radially outwardly stepped portion, and the shaft having a radially inwardly stepped portion adjacent each end of the shaft that is positioned so that each of the radially outwardly stepped portions of the bores are axially aligned with a respective radially stepped portion of the shaft, when the shaft is mounted in the bore. The stepped portions of the bores and shaft cooperate to define a bearing cavity between the respective stepped portions of the bores and shaft. Also, a respective one of the coolant source passageways and respective one of the coolant drain passageways are in fluid communication with each of the bearing cavities and arranged to provide a flow of coolant through the bearing cavity. Still other features of the exhaust gas recirculation valve embodying the present invention include a bearing disposed in each of the bearing cavities and a seal member disposed between an outer cylindrical portion of each of the bearings and the bore in housing, and a seal member disposed between the inner cylindrical surface of each of the bearings and the shaft.

Yet other features of the EGR valve embodying the present invention include each of the bearings comprising a sleeve beating having a pair of axially spaced annular grooves formed in an outer cylindrical surface wherein a first one of the pair of annular grooves is in fluid communication with one of the passageways connected to a source of coolant and the second one of the pair of annular grooves is in fluid communication with one of the passageways connected to the coolant drain. A plurality of circumferentially spaced slots, formed in the inner cylindrical surface of each of the bearings, are disposed in parallel relationship with the longitudinal axis of the valve. The bearing also includes a plurality of radially oriented holes, each of which is arranged to provide fluid communication between one of the annular grooves and one of the annular slots.

Still other features of the EGR valve embodying the present invention include the throttle blade of the valve being attached to the shaft at a central portion of a predefined surface area of the throttle blade whereby, when the first portion of the blade is exposed to a flow of exhaust gas through the internal chamber, the first portion of the blade is substantially pressure balanced. Still additional features include the means for rotating the shaft between the first and second positions and to selective intermediate positions between the second and first positions, includes a stepper motor that is mounted in a water-cooled housing. Other arrangements of the exhaust gas recirculation valve embodying the present invention include the internal chamber comprising two chambers, each communicating with a respective exhaust manifold, and the shaft extending through both chambers and having separate throttle blades mounted on the shaft to control the flow of exhaust gas through each of the chambers.

BRIEF DESCRIPTION OF THE SEVERAL VIEWS OF THE DRAWINGS

A more complete understanding of the structure and operation of the present invention may be had by reference to the following detailed description when taken in conjunction with the accompanying drawings, wherein.

DETAILED DESCRIPTION OF THE INVENTION

Figure 1:
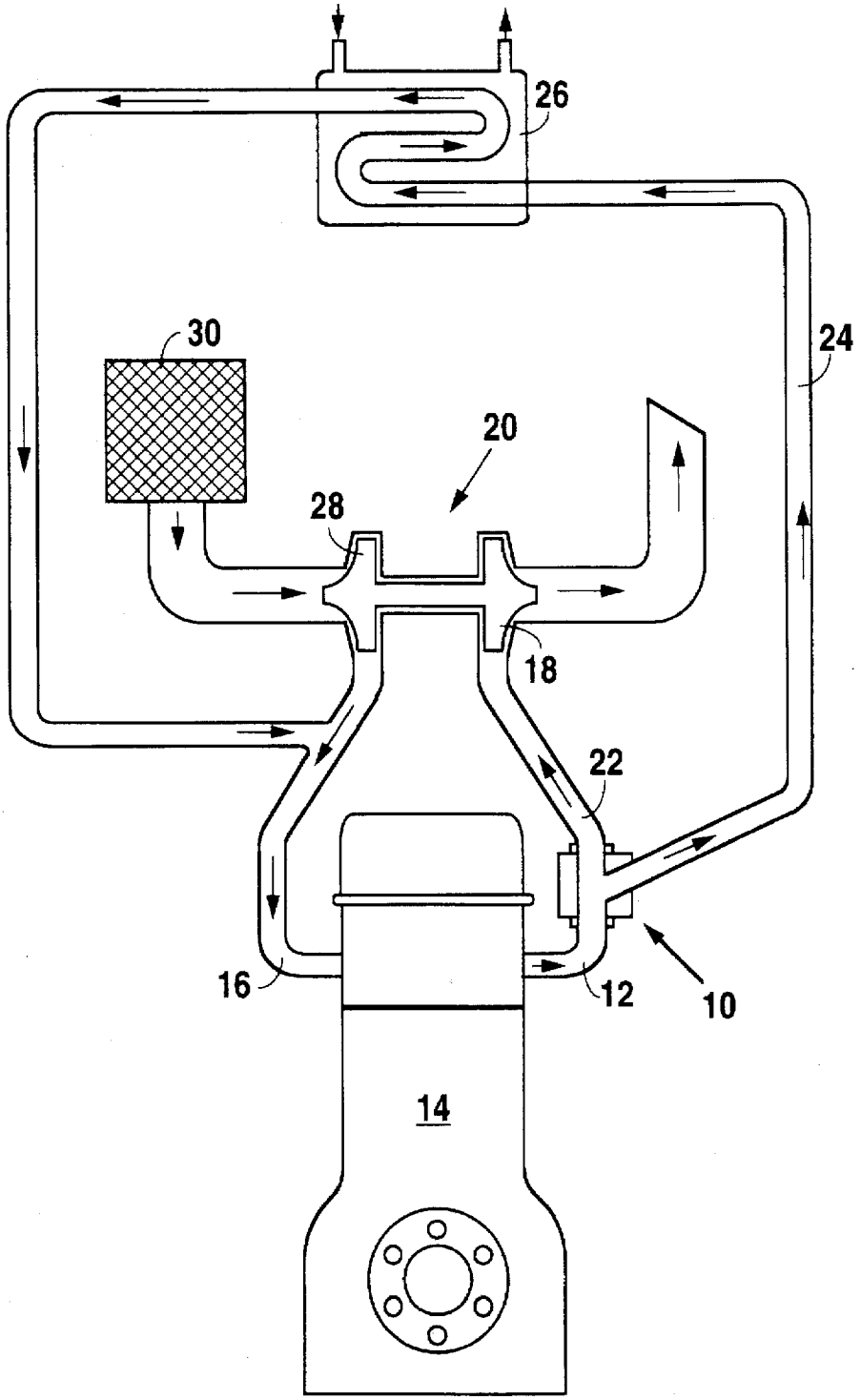
FIG. 1 is a schematic view of a high pressure loop exhaust gas recirculation system having a two-way, liquid-cooled, exhaust gas recirculation valve embodying the present invention.

An exhaust gas recirculation valve 10, embodying the present invention, is described herein with specific application to a high pressure loop (HPL) exhaust gas recirculation (EGR) system as shown in FIG. 1. The HPL system includes an exhaust manifold 12 connected to the exhaust port of an engine, such as a heavy duty diesel engine 14, and an intake manifold 16 that is in direct communication with the intake ports of the engine 14. Often, heavy duty diesel engines have two exhaust manifolds, and the EGR valve 10 illustrated herein is specifically adapted for use with an engine having two exhaust manifolds and a split turbine inlet housing in the turbocharger. In other arrangements, the engine may have a single exhaust manifold and the turbocharger may have a single turbine inlet port. The EGR valve 10 embodying the present invention, is positioned between the exhaust manifold 12 and the inlet to a turbine section 18 of a turbocharger 20. In the preferred embodiment of the present invention described and illustrated herein, the EGR valve 10 is bolted (sandwiched) directly between the exhaust manifold 12 and an the inlet to the turbine section 18 of the turbocharger 20. However, if desired, a high pressure exhaust flow duct may be provided between the EGR valve 10 and the exhaust manifold 12, and/or a high pressure exhaust flow duct between the EGR valve 10 and the inlet to the turbine section 18 of the turbocharger 20 if the turbocharger 20 is mounted at a position spaced from the EGR valve 10. An exhaust gas recirculation duct 24 provides fluid communication between the EGR valve 10 and the inlet manifold 16 of the engine 14. Desirably, recirculated exhaust gas flowing through the EGR duct 24 passes through an EGR heat exchanger, or cooler, 26 that reduces the temperature of the recirculated exhaust gas prior to reintroduction into the engine. The discharge of a compressor stage 28 of the turbocharger 20 draws ambient air through an air filter 30, compresses the air, and discharges it into the intake manifold 16 of the engine 14.

Turning now to FIGS. 2–7, the exhaust gas recirculation valve 10 embodying the present invention comprises a throttle body, or housing, 32 having an exterior surface 34, an interior surface 36 defining one or more internally disposed chambers 38, an inlet port 40 that is adapted for fluid communication with the exhaust manifold 12 of the engine 14, a first discharge port 42 in direct fluid communication with the turbine inlet port 18 of the turbocharger 20, and a second discharge port 44 in fluid communication with the intake manifold 16 of the engine 14 by way of the exhaust gas recirculation duct 24. In the preferred embodiment of the present invention, the inlet port 40 is aligned with the first discharge port 42, with the second discharge port 44 being formed through a side wall of the internal chamber 38.

The housing 32 further includes a first bore 46 extending between the internal chamber 38 and the exterior surface 34 of the housing 32 and is concentrically formed about a longitudinal axis 48 extending through the internal chamber 38 of the housing 32. The housing 32 further includes a second bore 50 that is coaxially aligned with the first bore 46 and extends from the internally disposed chamber 38 to an opposed portion of the exterior surface 34 of the housing 32. Desirably, each of the bores, 46, 50 have a radially outwardly stepped portion 52 formed in a portion of the bore adjacent the respective exterior surface 34 of the housing 32.

Figure 2:
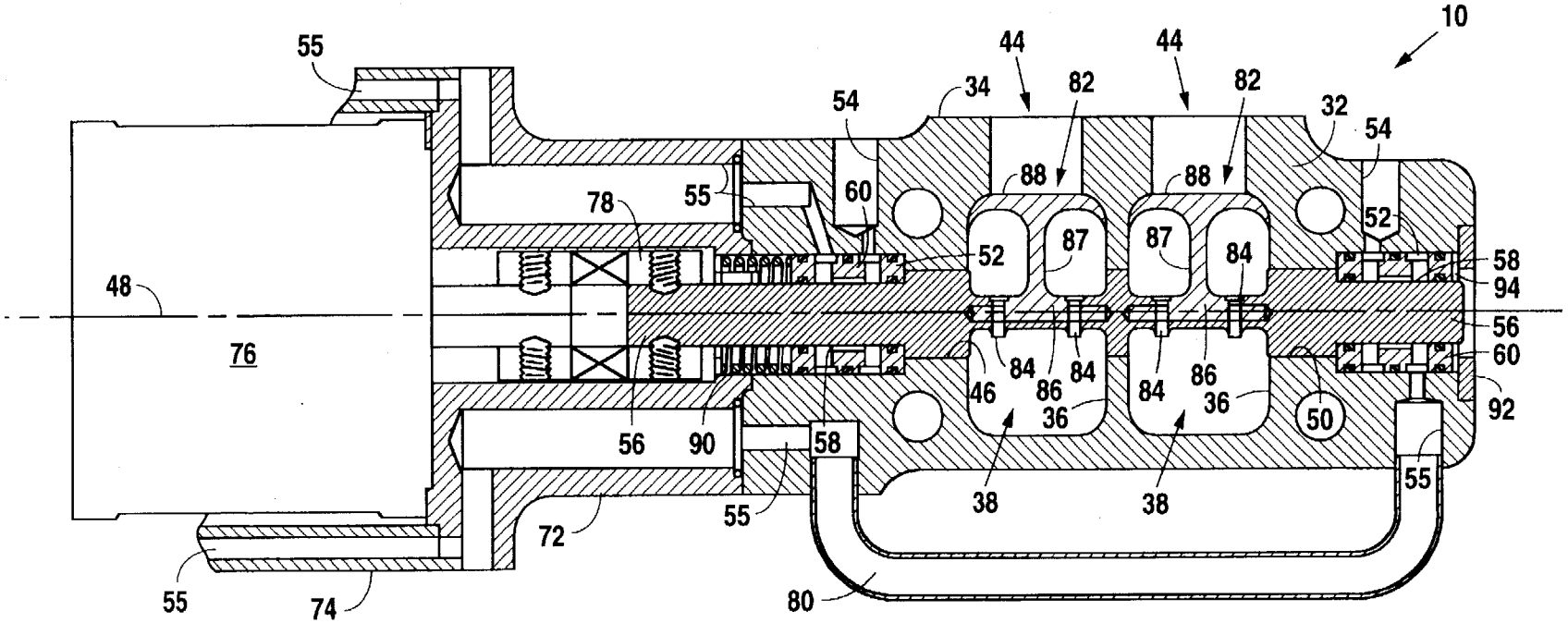
FIG. 2 is a sectional view of the two-way, liquid-cooled, exhaust gas recirculation valve embodying the present invention.

The housing 32 further includes a plurality of coolant supply and drain passageways 54, 55 that are formed in the housing 32 and extend from respective connection ports on the exterior surface 34 of the housing 32 to the stepped portion 52 of the bores 46, 50. As best shown in FIG. 2, the coolant supply passageways 54, are connected to a source of coolant, whereas the coolant drain passageways 55 are connected, as explained below in greater detail, to a coolant drain.

The exhaust gas recirculation valve 10 further includes a shaft 56 that is rotatably mounted in the first and second bores 46, 50 of the housing 32. Desirably, the shaft 56 has a radially inwardly stepped portion 58, adjacent each end of the shaft 56 that is positioned so that each of the radially outwardly stepped portions 52 of the respective bores 46, 50 is axially aligned with the respective radially inwardly stepped portion 58 of the shaft 56 when the shaft 56 is mounted in the bores 46, 50. The outwardly stepped portions 52 of the bores 46, 50 and the inwardly stepped portions 58 of the shaft 56 cooperate to define a bearing cavity between the respective stepped portions 52, 58. Importantly, a respective one of the coolant source passageways 54 and a respective one of the coolant drain passageways 55 are in fluid communication with each of the bearing cavities and are arranged to provide a flow of coolant through each of the bearing cavities.

The exhaust gas recirculation valve 10 embodying the present invention further includes a bearing 60 disposed in each of the bearing cavities and a seal member 62 disposed between an outer cylindrical surface of each of the bearings 60 and the respective bore 46, 50, and an additional seal member 62 disposed between the inner cylindrical surface of each of the bearings 60 and the shaft 56. In the preferred embodiment of the present invention, the seal members 62 are 0-rings formed of an elastomeric material having a high surface temperature service rating.

The bearing 60 positioned on the left side of the internal chamber 38, as viewed in FIG. 2, is loaded against the stepped shaft 56 by a load spring 90. The spring-applied load is transmitted through the shaft 56 to the bearing 60 disposed on the right side of the internal chamber 38. The right side bearing 60 is restrained by a retaining flange 92 and a shim washer 94. The axial sealing feature, incorporated in the exhaust gas recirculation valve 10 embodying the present invention, produces forced bearing side contact at the step locations and greatly increases cooling of the shaft 56 and shields the 0-rings 62 from hot exhaust gases flowing through the internal chamber 38.

Figure 3:
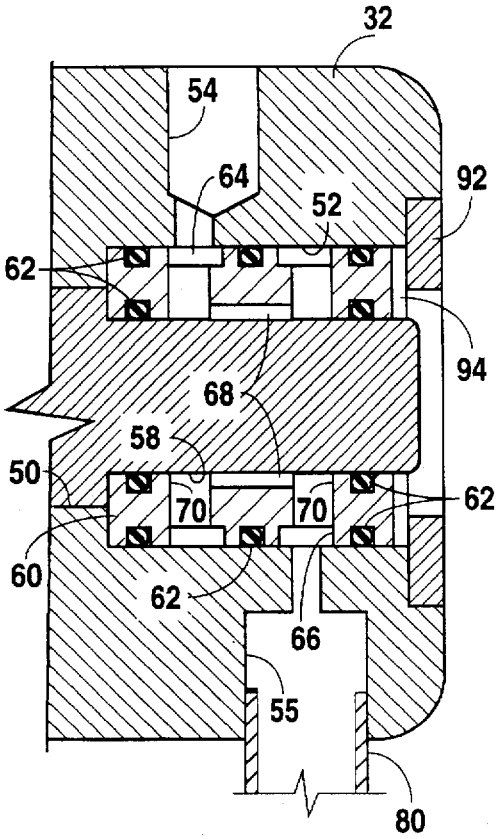
FIG. 3 is an enlarged sectional view of the liquid-cooled bearing and seal arrangement of the exhaust gas recirculation valve embodying the present invention.

As shown in greater detail in FIG. 3, each of the bearings 60 have a pair of axially spaced annular grooves 64, 66 formed in an outer cylindrical surface of the respective beatings 60. A first one of the annular grooves 64 is in fluid communication with the fluid passageway 54 connected to a source of coolant, and a second one of the annular grooves 66 is in fluid communication with a respective one of the drain passageways 55. A plurality of circumferentially spaced slots 68 are formed in the inner cylindrical surface of each of the bearings 60 and aligned in parallel relationship with the longitudinal axis 48. A plurality of radially oriented holes 70 are arranged to provide respective fluid communication between one of the annular grooves 64, 66 and one of the slots 68.

With specific reference now to FIG. 2, liquid coolant is supplied to the two coolant inlets provided on the top side of the housing 32. The coolant flows through the respective passageways 54, formed in the housing 32, into a corresponding one of the bearing bores 46, 50. The first annular groove 64 on the outer surface of the bearing 60 distributes coolant around the periphery of the bearing 60 and directs the coolant flow to the radially oriented holes 70 and thence to the slots 68. In the preferred embodiment, the coolant flows through four radially ranged holes 70 that intersect four circumferentially spaced, longitudinally oriented, slots 68 formed in the inside diameter surface of each of the bearings 60. The slots 68, which are arranged parallel to the shaft 56 center line, are machined into the actual bearing surface and allow coolant to flow along the surface of the shaft for a distance of about ½ inch (1.2 cm), then through four additional radially arranged holes 70 and into the second annular groove 66. The coolant flows through the slots 68, and is then discharged from the beating cavity by the drain passages 55 in the housing 32 which further extend through a motor mounting flange 72 and a shell, or mounting chassis, 54 enclosing a shaft drive motor 76. In the illustrative preferred embodiment, the coolant flows through the motor mounting shell 74 for a length of about 12 in. (30.5 cm). Directing the coolant through the motor mounting flange 72 and the motor shell 74 keeps a coupling 78 between the motor 76 and the shaft 56 cool, and advantageously provides a conveniently positioned drain discharge for the heated coolant to exit the EGR valve 10. Also, the coolant is advantageously directed very close to the seal members 62, and the bearings 60 are generously flooded with a continuous flow of coolant. A transfer tube 80 provides fluid communication for coolant drain between the second annular groove 66, adjacent the end of the housing 32 spaced from the motor 76, and the drain passageways 55 provided in the motor mounting flange 72 and the shell 74.

Figure 4:
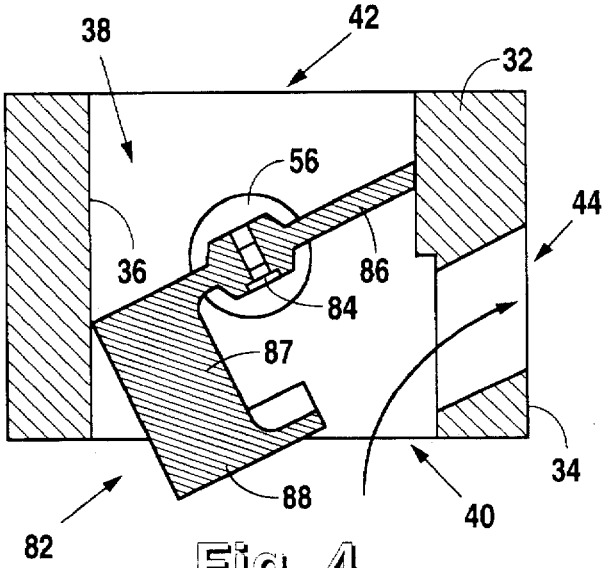
FIG. 4 is a sectional view of the exhaust gas recirculation valve showing the throttle blade of the valve fully closed and the exhaust gas recirculation passage fully open.
Figure 5:
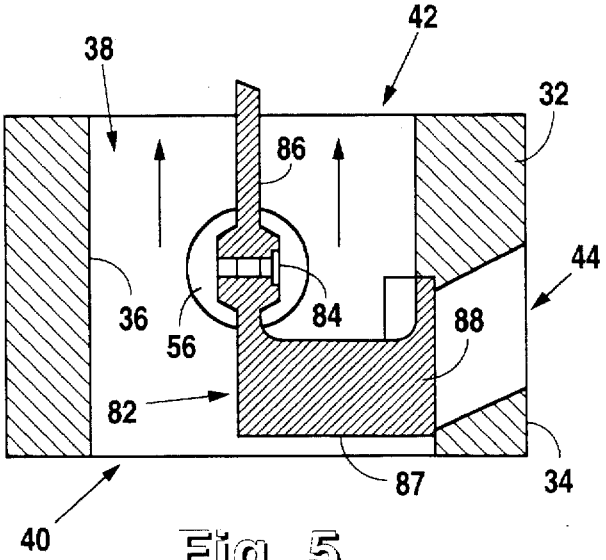
FIG. 5 is a sectional view of the exhaust gas recirculation valve embodying the present invention showing the throttle blade of the valve in a fully open position and the exhaust gas recirculation passage fully closed.

Importantly, the exhaust gas recirculation valve 10 embodying the present invention includes a throttle blade 82 for each of the internally disposed chambers 38. The throttle blades 82 are fixedly attached to the shaft 56, for example by retaining screws 8,1, and have a first portion 86 that is shaped to block exhaust gas flow through the internal chambers 38 to the first discharge port 42, as shown in FIG. 4, when the shaft 56 is rotated to a first position. The throttle blade 82 further includes a second portion 88 that is spaced from the first portion 86 by a web-shaped strut 87, and is shaped to block the second discharge port 44, as shown in FIG. 5, when the shaft 56 is rotated to a second position. Preferably, each of the throttle blades 82 are machined from stainless steel and shaped to fit the contours of the interior chamber 38 to selectively block the flow of exhaust gas to the respective first and second discharge ports 42, 44. The first portion 86 of the throttle blade 82 is attached to the shaft 56, and is pressure balanced. More specifically, the first portion 86 of the throttle blade 82 has a defined surface area that is substantially planar, and the throttle blade 82 is attached to the shaft 56 at a midpoint of the defined surface area whereby, when the first portion 86 of the throttle blade 82 is exposed to a flow of exhaust gas through the internal chamber 38, the forces imposed on the first portion 86 are substantially equally distributed on each side of the mounting point of the throttle blade 82 to the shaft 56. This is important because high torsional loads could be imposed on the motor 76 during high degrees of back pressure throttling, likely resulting in overpowering the motor 76.

The second portion 88 of the throttle blade 82 has a smaller surface area than the first portion of the blade 86 and is not pressure balanced with respect to the flow pressures in the internal chamber 38 and in the second discharge port 44. However, the pressure differential across the second portion 88 of the throttle blade 82, which is contoured to block the second discharge port 44 communicating with the EGR duct 24, typically does not exceed 3 psi. Thus, the "wing type" throttle blade 82 having the first portion 86 that is adapted to block the first discharge port 42 in direct communication with the turbine inlet port 18 of the turbocharger 20, and the second portion 88 providing blockage of the second discharge port 44 communicating with the exhaust gas recirculation duct 24, are positionable to completely close either the first or second discharge ports, or may be positioned at an intermediate position where flow is distributed between the first and second discharge ports 42, 44. Therefore, the EGR valve 10 embodying the present invention functionally serves as a three-way diverter valve, while having the simple construction of a two-way throttling valve.

Figure 8:
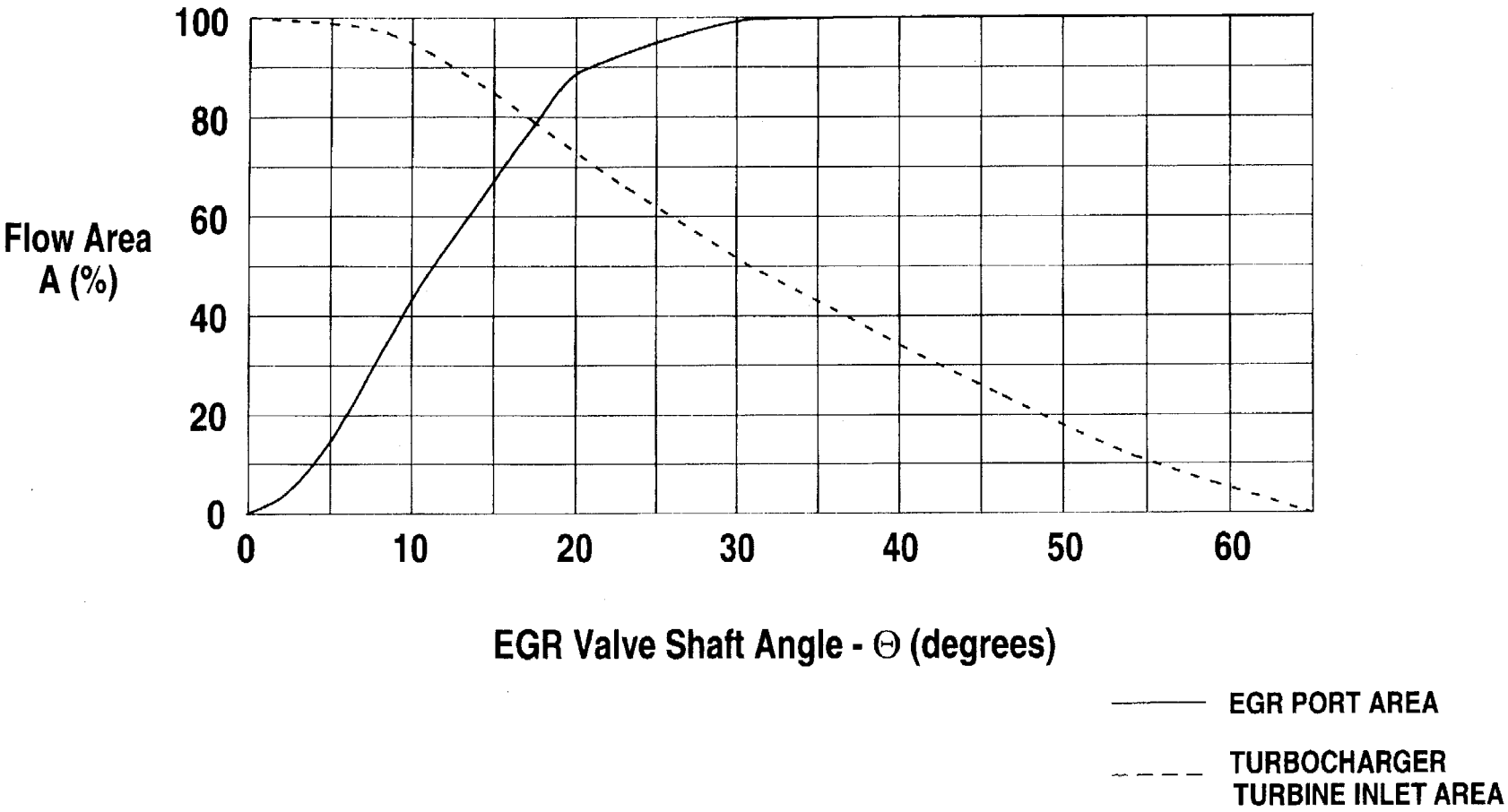
FIG. 8 is a graph showing the respective open area percent of an EGR port and a turbocharger turbine inlet area at various angles of a shaft on which the throttle blade is mounted.

Importantly, the valve 10 controllably modulates the throttle blade 82 between the above-described first and second positions to direct relative varying amounts of exhaust gas to the recirculation loop and to the turbocharger 20. Advantageously, back pressure is maintained (i.e., flow to the turbine inlet 18 is at least partially restricted) to assure a flow of recirculated exhaust gas, through the recirculation loop, to the intake manifold 16. More specifically, rotation of the throttle blade 82 simultaneously opens the EGR flow port 44 and while maintaining back pressure to drive EGR. As illustrated in FIG. 8, in which the 0° shaft angle $\theta$ represents the above-described second position of the throttle blade 82 whereat the second discharge port 44 (EGR port) is closed, the flow area A % of the second discharge port 44 increases rapidly whereas the flow area A % of the first discharge port 42 (turbocharger turbine inlet) gradually decreases. For example, at a shaft angle$\theta$ of only 15° from the second position, the EGR port 44 area A is about 65% open, whereas the turbine inlet area A is only reduced by about 15%. Furthermore, when the shaft angle is 30° the EGR port 44 is substantially fully open, whereas the turbine inlet area A to the turbocharger 20 is reduced less than 50%. Thus, it can be seen that the area A increase of the EGR port is at a rate that is greater than the area A decrease of the turbocharger inlet port 18. Moreover, because the turbine inlet area is only partially closed even when the EGR port is fully open, back pressure is provided to assure a flow of exhaust gas through the exhaust gas recirculation duct 24.

Figure 6:
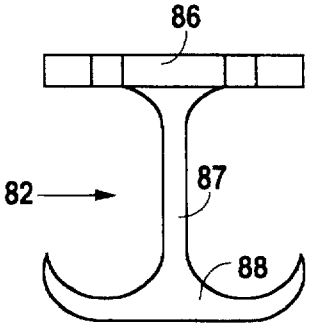
FIG. 6 is an end view of the throttle blade of the exhaust gas recirculation valve embodying the present invention.
Figure 7:
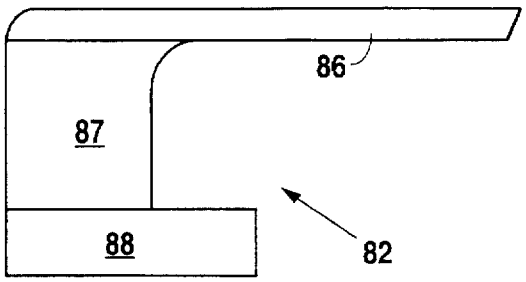
FIG. 7 is a side view of the throttle blade of the exhaust gas recirculation valve embodying the present invention.

As can be readily seen, in the EGR valve 10 embodying the present invention, the throttle blade geometry is arranged so that small changes in shaft or blade angle ($\delta\theta$) effects large changes ($\delta$A) in the EGR flow port. The shape of the throttle blade 82 may be better understood with reference to FIG. 6, showing an end view of the throttle blade 82 and FIG. 7, which shows a side view of the throttle blade 82.

The motor 76 provides a means for rotating the shaft 56 between the first and second positions, shown respectively in FIGS. 4 and 5, and to selective intermediate positions between the first and second positions. In the preferred embodiment of the present invention, the motor 76 comprises a computer controlled stepper motor that rotates in small, uniform angular movements. As noted above, the stepper motor 76 is advantageously mounted in a water-cooled mounting chassis, or shell, 74 which significantly increases the service life of the motor 76. If desired, other conventional drive devices may be used to rotate the shaft 56.

Thus, the exhaust gas recirculation valve 10 embodying the present invention provides a modulatable throttle blade 82 that covers the bypass port 44 when the valve 10 is in the zero exhaust gas recirculation position and directs all of the exhaust flow to the turbine inlet port 18 of the turbocharger 20. At this position, illustrated in FIG. 4, there is zero back pressure throttling and the exhaust gas recirculation duct 44 is fully blocked. In this configuration, very little volume is added to the preturbine exhaust system, resulting in engine performance that is nearly identical to baseline engine performance. Additionally, the exhaust gas recirculation valve 10 embodying the present invention does not require the use of a separate exhaust gas recirculation shutoff valve. Moreover, the valve 10, embodying the present invention, simultaneously provides EGR back pressure while diverting a portion of the exhaust flow through the exhaust gas recirculation duct 24.

The exhaust gas recirculation valve 10 embodying the present invention is particularly applicable to heavy duty diesel engines and other turbocharged engines having high pressure loop exhaust gas recirculation. In a carefully controlled test, a Detroit Diesel Series 60 heavy duty diesel engine was tested under full load over a speed range of 1,200 rpm to 2,100 rpm. Various parameters were measured to determine air/fuel ratio (A/F), smoke produced (Bosch Smoke Test), and brake specific fuel consumption (BSFC) over the stated speed range. In the first series of tests, the turbocharger was mounted directly to the exhaust manifold, whereas in the second series of tests the above-described EGR valve 10, embodying the present invention, was inserted between the exhaust manifold and the turbocharger. The test data showed no appreciable differences in A/F ratio, smoke, or BSFC between the two test arrangements, demonstrating that the small flow path volume added by the internal chamber 38 of the EGR valve 10 did not adversely affect engine operation.

Although the present invention is described in terms of a preferred exemplary embodiment with specific key constructions of the internal chambers and passageways within the exhaust gas recirculation valve, those skilled in the art will recognize that changes in those constructions may be made without departing from the spirit of the invention. For example, the EGR valve embodying the present invention may be configured to have a single internally disposed chamber, or two chambers as shown and described with respect to the preferred embodiment of the present invention. Such changes are intended to fall within the scope of the following claims. Other aspects, features and advantages of the present invention may be obtained from a study of this disclosure and the drawings, along with the appended claims.

What is claimed is:

1. An exhaust gas recirculation valve interposed between an exhaust manifold and a turbocharger of an internal combustion engine, said valve comprising:

a housing having an exterior surface, an interior surface defining an 4 internally disposed chamber, an inlet port extending between said exterior surface and said internal chamber and adapted for fluid communication with said exhaust manifold of the engine, a first discharge port extending between said internal chamber and said exterior surface and adapted for fluid communication with a turbine inlet port of said turbocharger, a second discharge port extending between said interior chamber and said exterior surface and adapted for fluid communication with an intake port of said engine, a first bore extending between said internal chamber and the exterior surface of the housing and concentrically formed about a longitudinal axis extending through the internal chamber of said housing, a second bore coaxially aligned with said first bore and extending between said internal chamber of the housing and an opposed exterior surface of the housing;

a shaft rotatably mounted in said bore of the housing;

a throttle blade fixedly attached to said shaft and having a first portion shaped to block said first discharge port when said shaft it rotated to a first position, and a second portion spaced from said first portion and shaped to block said second discharge port when said shaft is rotated to a second position; and a means for rotating said shaft between said first and second positions and to selective intermediate positions between said first and second positions.

2. An exhaust gas recirculation valve, as set forth in claim 1, wherein said first portion of the throttle blade has a predefined surface area and said throttle blade is attached to said shaft at a midpoint of said predefined surface area whereby, when said first portion of the blade is exposed to a flow of exhaust gas through said internal chamber, said first portion of the blade is substantially pressure balanced.

3. An exhaust gas recirculation valve, as set forth in claim 1, wherein said exhaust comprises two parallel internal chambers, each in fluid communication with an inlet port extending between said exterior surface and the respective internal chamber and adapted for fluid communication with separate exhaust manifolds of the engine, each of said internal chambers further having a first discharge port extending between the respective internal chamber and said exterior surface and adapted for fluid communication with a turbine inlet port of said turbocharger and a second discharge port extending between the respective interior chamber and said exterior surface and adapted for fluid communication with an intake port of said engine, and said shaft extending through both chambers and having two throttle blades fixedly attached thereon that are axially positioned along said shaft so that one throttle blade is disposed in each of said internal chambers.

4. An exhaust gas recirculation valve, as set forth in claim 1, wherein said means for rotating said shaft between said first and second positions and to selective intermediate positions between the first and second positions includes a stepper motor operatively coupled to said shaft.

5. An exhaust gas recirculation valve, as set forth in claim 4, wherein said stepper motor is mounted in a water-cooled shell.

6. An exhaust gas recirculation valve, as set forth in claim 1, wherein when said throttle blade is rotated from said second position to said first position, the flow area of the second discharge port increases and the flow area of the first discharge port simultaneously decreases, said increase in the flow area of the second discharge port being at a rate greater than the decrease in the flow area of the first discharge port.

7. An exhaust gas recirculation valve, as set forth in claim 6, wherein when said throttle blade is rotated 30° from said second position toward said first position, said second discharge port is substantially fully open and said first discharge port is reduced less than about 50%.

8. An exhaust gas recirculation valve, as set forth in claim 1, wherein said housing includes a plurality of internal passageways each of which extend from said exterior surface of the housing to a respective one of the first and second bores formed in the housing, each of said passageways being adapted for respective connection with one of a source of coolant and a coolant drain whereby a flow of liquid coolant is respectively provided to the first and second bores through said passageways adapted for connection with a source of coolant and discharged through said passageways adapted for connection with the coolant drain.

9. An exhaust gas recirculation valve, as set forth in claim 8, wherein said first and second coaxially aligned bores in the housing each have a radially outwardly stepped portion and said shaft has a radially inwardly stepped portion adjacent each end of the shaft and positioned such that each of the radially outwardly stepped portions of the bores is axially aligned with a respective radially inwardly stepped portion of the shaft when said shaft is mounted in said bores and said stepped portions of said bores and said shaft cooperate to define a bearing cavity between the respective stepped portions of said bores and said shaft, and a respective one of said coolant source passageways and a respective one of said coolant drain passageways being in fluid communication with each of said bearing cavities and arranged to provide a flow of coolant through said bearing cavities.

10. An exhaust gas recirculation valve, as set forth in claim 9, wherein said valve includes a bearing disposed in each of the bearing cavities and a seal member disposed between an outer cylindrical surface of each of said bearings and said bore in the housing and a seal member disposed between the inner cylindrical surface of each of said bearings and said shaft.

11. An exhaust gas recirculation valve, as set forth in claim 10, wherein each of said bearings comprises a sleeve bearing having a pair of axially spaced annular grooves formed in an outer cylindrical surface wherein a first one of said pair of annular grooves is in fluid communication with the passageway connected to a source of coolant and the second one of said pair of annular grooves is in fluid communication with the passageway connected to the coolant drain, a plurality of circumferentially spaced slots formed in the inner cylindrical surface of each of the beatings in parallel relationship with said longitudinal axis, and a plurality or radially oriented holes each of which is arranged to provide fluid communication between one of said annular grooves and one of said slots.

* * * * *